US008175286B2

(12) United States Patent
Bech et al.

(10) Patent No.: US 8,175,286 B2
(45) Date of Patent: May 8, 2012

(54) RECORDING, SYNTHESIS AND REPRODUCTION OF SOUND FIELDS IN AN ENCLOSURE

(75) Inventors: Søren Bech, Holstebro (DK); Geoffrey Glen Martin, Vinderup (DK); Flemming Christensen, Aalborg (DK); Woo-Keun Song, Aalborg (DK); Pauli Minnaar, Aalborg (DK)

(73) Assignee: Bang & Olufsen A/S, Struer (DK)

( * ) Notice: Subject to any disclaimer, the term of this patent is extended or adjusted under 35 U.S.C. 154(b) by 1114 days.

(21) Appl. No.: 11/915,503

(22) PCT Filed: May 22, 2006

(86) PCT No.: PCT/IB2006/051624

§ 371 (c)(1), (2), (4) Date: Nov. 26, 2007

(87) PCT Pub. No.: WO2006/126161

PCT Pub. Date: Nov. 30, 2006

(65) Prior Publication Data

US 2008/0212788 A1 Sep. 4, 2008

(30) Foreign Application Priority Data

May 26, 2005 (DK) ..... 2005 00768

(51) Int. Cl.
*G10K 11/16* (2006.01)
*H04R 5/00* (2006.01)

(52) U.S. Cl. ..... 381/71.4; 381/26; 381/56; 381/57; 381/58; 381/71.2; 381/91

(58) Field of Classification Search ..... 381/26, 381/56, 57, 58, 59, 71.2, 71.4, 91
See application file for complete search history.

(56) References Cited

U.S. PATENT DOCUMENTS

| | | | | |
|---|---|---|---|---|
| 5,544,249 | A | 8/1996 | Opitz | |
| 6,167,138 | A | 12/2000 | Shennib | |
| 6,219,645 | B1 * | 4/2001 | Byers | 704/275 |
| 6,243,476 | B1 * | 6/2001 | Gardner | 381/303 |
| 6,466,913 | B1 * | 10/2002 | Yasuda et al. | 704/500 |
| 7,024,259 | B1 * | 4/2006 | Sporer et al. | 700/94 |
| 7,333,622 | B2 * | 2/2008 | Algazi et al. | 381/310 |
| 2002/0006206 | A1 * | 1/2002 | Scofield | 381/27 |
| 2004/0091119 | A1 * | 5/2004 | Duraiswami et al. | 381/26 |

FOREIGN PATENT DOCUMENTS

DE 42 22 050 1/1993

* cited by examiner

*Primary Examiner* — Victor A Mandala
(74) *Attorney, Agent, or Firm* — Stites & Harbison PLLC; Douglas E. Jackson

(57) ABSTRACT

The invention relates to simulation of sound fields in enclosures, for instance for application in listening tests, where test subjects assess the sound quality or other sound perception characteristics of the sound field. According to a specific embodiment, the system comprises a binaural synthesis portion which synthesizes sound for instance from a sound-reproduction equipment based on measured impulse responses of an actual room stored in a data base (31) and a binaural recording portion comprising a data base 32 for storing binaural recordings of other sound signals made in the room. Data from these databases are mixed (41) and reproduced by means of a headphone (39) provided with a head tracker (42) for tracking the movements of the listener's head. The invention furthermore comprises the use of cross-fading functions (36, 37) to enable the dynamic listening conditions, where the movements of the listener's head are taken into account during the simulation process.

42 Claims, 4 Drawing Sheets

RECORDING, SYNTHESIS AND REPRODUCTION OF SOUND FIELDS IN AN ENCLOSURE

TECHNICAL FIELD

The invention relates generally to listening test systems and methods for enabling test subjects to perform listening tests relating to acoustic environments without the necessity to be actually present in said environment, where the systems and methods apply binaural synthesis, recording and playback, and more particularly to the application of such systems and methods to perform listening tests in automobiles.

BACKGROUND OF THE INVENTION

It is desirable to be able to compare audio reproduction systems and algorithms under realistic conditions, i.e. in the environment where such systems and algorithms are to be used. Such environments could in principle be any listening room, but specific problems are encountered in rooms of very limited dimensions and rooms where significant background noise or other competing sounds are present. An example of an environment of this type is the cabin of an automobile. In recent years audio equipment for use in automobiles has become increasingly sophisticated and powerful, being capable of yielding high fidelity reproduction comparable to high fidelity sound reproduction at home. This development has lead to an increasing demand from manufacturers of automotive audio equipment for measurement systems and methods enabling realistic assessment of the sound quality of equipment installed in a car and for comparison of sound quality between different equipment and/or cars. Often the above assessment and comparisons involve A/B comparison listening tests, wherein a panel of test subjects participates, where the test subjects assessed sound quality or other pertinent psychoacoustic attributes of sounds reproduced by a given system in the cabin of a vehicle and compared this assessed sound quality with the sound quality or other attributes similar to the above-mentioned of another system, or of the same system with other parameter settings, in the same cabin of a vehicle. Alternatively the same system with the same parameter settings but installed in two different vehicles may be compared by A/B comparisons according to experimental protocols well known within the art of experimental design.

A/B comparisons and for that matter also other assessment techniques in which test subjects participate are difficult, time-consuming and expensive to carry out in-situ in connection with automotive audio equipment. Specifically, it may be impossible—or at least not advisable—to let the driver of the car participate in such listening tests while actually driving the car. There is therefore a need for simulation systems and methods for realistically simulating the sound fields generated in the cabin of a vehicle, where the simulation takes into account not only the sound reproduction equipment installed in the cabin of the vehicle but also the various background noises in the cabin and—optionally—also competing sounds in the vehicle, such as a person speaking for instance sitting next to the driver, which to some extent may influence the sound perception of a listener in the cabin of the vehicle.

SUMMARY OF THE INVENTION

On the above background it is an object of the present invention to provide a system and method for carrying out realistic A/B comparisons and other test procedures involving test subjects, where the system and method are particularly suitable—although not exclusively suitable—for assessing sound quality and other psychoacoustic attributes in an automobile environment, specifically in the cabin of a car.

It is furthermore—in a more general manner—an object of the present invention to provide a system and method for simulating the acoustic environment for instance in an enclosure. Generally, the simulation comprises any perceptually relevant quantities of the acoustic environment. Specifically, the simulation of sound fields in the cabin of an automobile is dealt with in detail in the detailed description of the invention, but this is not to be regarded as a limitation of the applicability of the system and method according to the invention. Thus, for instance, the system and method according to the invention could be used for simulating the acoustic environment in aircraft cabins, railway compartments, space shuttles, assembly halls, kitchens and many other environments.

The above objects and advantages are attained by a system according to the invention for recording acoustical quantities or sound samples characterising a sound field which is at least partly generated by electroacoustic reproduction equipment as defined in claim 1, a system according to the invention for carrying out listening tests on simulated sound fields in a room, for instance the cabin of a vehicle as defined by claim 10, and a method according to the invention as defined in claim 25 of the appended set of claims. Various embodiments of the system and method according to the invention are defined by the dependent claims and will be described in detail in the detailed description of the invention.

Thus, according to the invention there is provided a system which can for instance be used for carrying out listening tests on psychoacoustic attributes of sound fields at least partly generated by audio equipment in a listening room, specifically but not exclusively, in the cabin of a car, said system comprising a binaural recording system for making binaural recordings of actual sound fields in a room or cabin; a binaural synthesis system for simulating the sound provided to a listener (for instance the sound pressure in the ear canals of a listener) by audio equipment installed in said room or cabin and an binaural playback system for binaural reproduction of the simulated sound field of the room or cabin. According to a preferred embodiment of the system according to the invention, playback takes place via a pair of headphones worn by a test person, but playback could in principle also take place via loudspeakers. Furthermore, according to a preferred embodiment the system is provided with means for sensing the movement of the test person's head and reacting accordingly.

According to the present invention there is thus provided a system for recording acoustical quantities or sound samples characterising a sound field in a room, such as the cabin of a vehicle, where the sound field could be partly generated by electro-acoustic reproduction equipment installed in the room, the system comprising an acoustic mannequin comprising an artificial head and a torso portion for making binaural recordings of sounds in said room and signal generator means for providing measurement signals to input terminals of said electroacoustic reproduction equipment and determining means for determining a function H(R) characterising the relationship between a sound pressure generated in or at the ear canal replicas of said artificial head, the artificial head having a given orientation R relative to said sound field and an input signal to said electroacoustic reproduction equipment, where the system furthermore comprises storage means for storing said function H(R) and storage means for storing binaural recordings made by means of said acoustic mannequin of other signal components of said sound field, such as background noises for instance originating from the engine of a vehicle, wind noises, noise from the tyres, etc.

According to a first embodiment of the invention, the function H(R) is measured by providing a given input terminal of the electroacoustic reproduction equipment with a suitable signal, which signal, after processing in the reproduction equipment, is being radiated from all loudspeakers of the reproduction system simultaneously, thus giving rise to a total resulting sound field in the room, this sound field being recorded by means of an acoustic mannequin and converted to left and right output signals from the microphones in the ear replicas of the mannequin. The function H(R) according to this embodiment of the invention thus characterises one input terminal or channel of the total sound installation in a given room and not the individual reproduction lines comprising each individual loudspeaker.

Alternatively, a function $H_{IND}(R)$ characterising each individual reproduction line might be determined by providing a single loudspeaker at a time with an output signal from the electroacoustic reproduction equipment and thus determine functions $H_{IND}(R)$ corresponding to each individual reproduction line and based on these functions determine the total function H(R) characterising the total reproduction system. The latter alternative may be advantageous in that it provides for the possibility to optimise sound reproduction from each individual loudspeakers of the installation separately (such as a loudspeaker mounted in a door of the vehicle) or from a given sub-group of loudspeakers (all radiating sound during the determination of the corresponding $H_{IND}(R)$), for instance all front loudspeakers in a surround sound installation.

According to a specific embodiment of the present invention, the characterising function H(R) is the binaural room impulse response BRIR obtained by supplying one input terminal of said reproduction equipment at a time with a suitable signal from a generator/analyser device and recording and analysing the corresponding sound pressure in the ear canal and pinna replicas of the artificial head by said generator/analyser device.

According to other embodiments of the invention, said function H(R) could for instance be the binaural transfer function H(f;R).

It is understood that any of these functions could either be determined with all loudspeakers radiating sound simultaneously or with only a single loudspeaker at a time (or a sub-group of loudspeakers at a time) radiating sound as explained above.

According to another embodiment of the present invention, a function $H_C(R_C;R)$ characterising reception of a competing sound signal could furthermore be determined, thus providing for the possibility to simulate a sound field in a room, for instance the cabin of a vehicle, comprised by wanted sound generated by the sound reproduction equipment installed in the cabin, inevitable background noises in the cabin and for instance a person speaking from a different position in the cabin.

According to this embodiment, a system as described above is thus provided, where the system furthermore comprises sound-generating means for emitting an alternative sound signal. This signal could for instance be a competing sound signal such as speech from one or more further persons—in addition to the specific listener, who actually wants to listen to the sound reproduced by the sound reproduction equipment. In this case, the speech would be considered as a competing sound, which could possibly degrade the perceived sound quality of the reproduction equipment. The opposite situation, where the speech signal could actually be regarded as the wanted sound signal and the sounds reproduced by the reproduction equipment would be regarded as competing or disturbing sounds, would also be possible, for instance during communication via a mobile phone while the sound reproduction equipment is turned on. Hence, the terms "wanted" or "competing" sounds are to be regarded as relative, the specific meaning of these terms being dependent on the specific situation actually dealt with. Specifically, the above-mentioned means could comprise an acoustic mannequin provided with an artificial mouth.

According to this embodiment of the invention, the system is furthermore provided with storage means for storing the function $H_C(R_C;R)$, characterising the relationship between a sound pressure generated in or at the ear canal replicas of said artificial head with the head having a given orientation R relative to said sound field and an input signal provided to said sound-generating means, where $R_C$ indicates the orientation of the sound-generating means relative to said sound field.

According to a specific embodiment of the invention, said function $H_C(R_C;R)$ is the binaural room impulse response $BRIR_C$ corresponding to the competing sound.

The invention furthermore relates to a system for carrying out listening tests on simulated sound fields in an enclosure, such as the cabin of a vehicle, the system comprising:

- Storage means for storing a function H(R), characterising the relationship between a sound pressure generated in or at the ear canal replicas of an artificial head with the head having a given orientation R relative to said sound field and an input signal to an electro-acoustic reproduction equipment provided in said room
- Storage means for storing binaural recordings $N_I(R)$ of sound signals made in said room, such as stationary or quasi-stationary background noises by means of said acoustic mannequin;
- Means for providing wanted sound signals, such as musical excerpts
- Binaural sound reproduction means, such as a headphone for providing a test subject with an acoustic test signal, where the binaural sound reproduction means is provided with a head tracker for tracking the movement and/or orientation of the head of the test subject relative to the sound field.
- Signal processing means for processing said wanted sound signals dependent on the movement and/or orientation of the test subjects as sensed by the head tracker.
- Mixing (or adding) means for mixing the processed wanted sound signals with said binaural recordings of sound signals or processed versions of these signals in given proportions, whereby mixed signals are provided.
- Processing means for providing said mixed signals to input terminals of said binaural sound reproduction means. Such processing means could for instance comprise a headphone equaliser used to attain a given, desired transfer function of a headphone used during listening tests carried out using the system according to the invention.

According to a specific embodiment of the invention, storage means for storing the individual functions $H_{IND}(R)$ may be provided and means for determining the function H(R) based on these individual functions.

As mentioned previously, the function H(R) could be the binaural room impulse response BRIR, and said processing means for processing the wanted sound signals dependent on the movement and/or orientation of the test subjects would in this case comprise means for carrying out a convolution of a chosen wanted sound signal with chosen binaural room impulse responses.

In the case where competing sounds are also to be included in simulations of the sound field in a room as described above, the system for carrying out listening tests on simulated sound fields in a room according to the invention would also have to comprise means for processing samples of competing sounds according to the location of the source of the competing sound and the orientation of the head of the listener, which will be described in detail in the following detailed description of the invention.

The present invention furthermore relates to a method for simulating the total sound field generated at least partly by a sound reproduction equipment in a room, such as the cabin of a vehicle, said method comprising:

Determining a plurality of binaural room impulse responses corresponding to said reproduction equipment and storing these responses.

Making a plurality of binaural recordings of other sound components such as background noises in the room and storing these recordings.

Convolution of a chosen of said binaural room impulse responses with a sample of a wanted sound signal giving a resulting room-related simulation signal corresponding to this sound.

Mixing said resulting simulation signal with a chosen one of said plurality of binaural recordings, thereby obtaining a binaural test signal for provision to a test subject via suitable binaural reproduction transducer means, such as a headphone, where the binaural reproduction transducer means is furthermore provided with means, such as a head tracker, for tracking the motion and/or orientation of the test subjects' head and where the signals provided by the tracking means are used for choosing said binaural room impulse responses and said binaural recordings.

According to a specific embodiment of the method according to the invention, the method furthermore comprises cross-fading between a given first binaural room impulse response ($BRIR_n$) and an adjacent second binaural room impulse response ($BRIR_{n+/-1}$) and between a given binaural recording corresponding to said first binaural room impulse response and an adjacent binaural recording corresponding to said second binaural room impulse response, respectively, controlled by said signals provided by the tracking means. The above "adjacent" binaural room impulse response is the impulse recorded by the artificial head at either of the two orientations of the artificial head which is adjacent to the impulse response indicated by index n, but it is also possible in the cross-fading to apply impulse responses corresponding to more remote orientations of the artificial head in cases where the test subject makes very rapid movements of his head. Thus, although application of the two neighbouring impulse responses $BRIR_{n+/-1}$ in the cross-fading procedures is specifically described in the following, also more remote impulse responses could be used, i.e., $BRIR_{n+/-m}$, where $m>1$.

Furthermore, the method according to the invention may be extended to simulation of the above-mentioned competing sounds, the method according to this embodiment being therefore extended by:

Determining a plurality of second binaural room impulse responses corresponding to competing sounds and storing these responses Convolution of a chosen of said second binaural room impulse responses with a sample of a competing sound signal giving a resulting second room-related simulation signal corresponding to this competing sound.

Mixing said resulting second simulation signal, said binaural test signal for provision of a resulting test signal comprising simulations of wanted sounds, competing sounds and background noises to a test subject via suitable binaural transducer means.

In order to facilitate the performance of listening tests by means of the system (and method) according to the invention, the system is advantageously provided with operational means for controlling provision of data (recorded impulse responses, binaural recordings, etc.) from various storage means or databases in the system, for collecting responses from the test subject via a suitable interface means—touch screen, keyboard, computer mouse, etc.—and optionally also for making analysis of data obtained during listening tests. Reproduction of simulated sounds during listening tests may not necessarily take place solely via headphones as described but could for instance be supplemented by low-frequency sound reproduction via suitable sub-woofers or tactile means (vibrators) enhancing the realism of the simulation.

The present invention thus furthermore relates to the use of a system according to the invention for recording quantities or sound samples characterising a sound field at least partly generated in the cabin of a vehicle by electroacoustic equipment installed in the vehicle, and a system according to the invention for carrying out listening tests on simulated sound fields in the cabin of a vehicle, or the use of a method according to the invention for the assessment of psychoacoustic attributes relating to the sound field in the cabin of a vehicle, or for comparing such psychoacoustic attributes relating to sound fields in the cabins of different vehicles.

The scope of the present invention also covers the use of the systems and method according to the invention in connection with assessment and comparisons of attributes of sound fields in other rooms/environments than the above-mentioned cabins of vehicles.

It is furthermore understood that the various functional items (the means for the binaural synthesis, the means for binaural recordings etc.—each of these means both with and without the cross-fading means described in the following detailed description of the invention) can not exclusively be used in connection with each other as described in the following but also separately. Thus, for instance, the binaural recording and reproduction means—with or without cross-fading means—described in the following can be used separately for simulating for instance large machinery installations where binaural synthesis methods would be difficult to implement in practice.

BRIEF DESCRIPTION OF THE DRAWINGS

The invention will be better understood with reference to the following detailed description of embodiments of the invention in conjunction with the drawing, where.

DETAILED DESCRIPTION OF THE INVENTION

Figure 1:
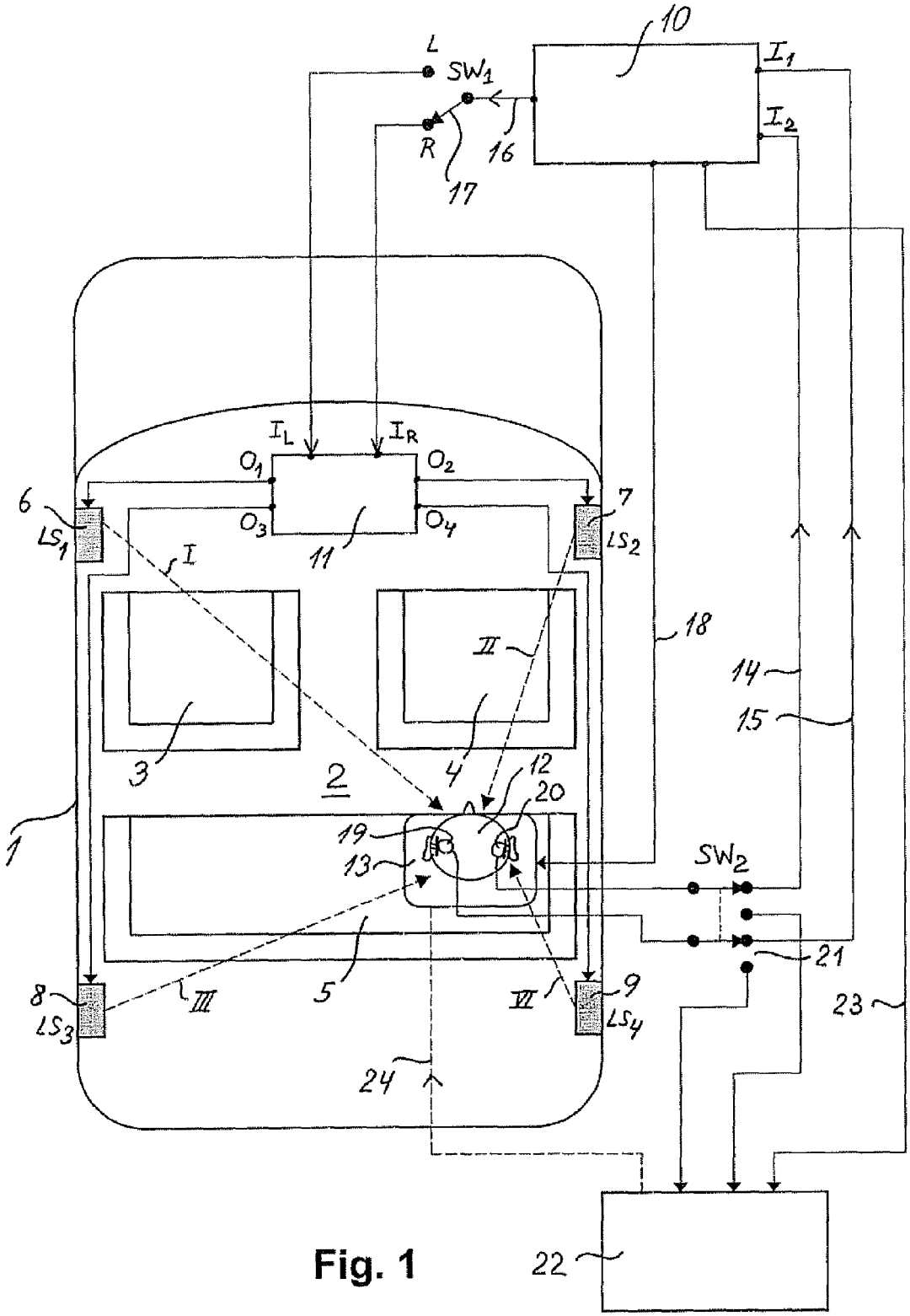
FIG. 1 shows a schematic exemplary representation of a set-up according to an embodiment of the invention for measuring binaural vehicle impulse responses (BVIR)—including major sound transmission paths—and for making binaural recordings of background noises in the cabin of a vehicle.

FIG. 1 shows an embodiment of a measurement and recording system according to the present invention. The system shown in FIG. 1 is applied for:

(1) Measuring the binaural vehicle impulse responses (BVIRs) of the whole sound reproduction chain from the input terminals $I_1$ and $I_2$ of an amplifier or other sound processing electrical device 11 for instance comprising tone controls or other filter arrangements for shaping the frequency response of the system and suitable power amplifiers with output terminals O1, O2, O3 and O4 providing signals to the loudspeakers LS1, LS2, LS3 and LS4, respectively. It is, however, understood that the measurement system could be used for measuring impulse responses relating to other portions of the reproduction system as will be referred to below.

(2) Making binaural recordings of background noises (stationary or quasi-stationary noises as explained in the summary of the invention) and storing these recordings in suitable storage means 22.

FIG. 1 specifically shows a schematic representation of the cabin 2 of a vehicle 1 provided with a sound reproduction equipment comprising electronic sound processing means, for instance an amplifier with appropriate tone controls or equaliser for shaping the frequency response of the system, and four loudspeakers, two front loudspeakers LS1 and LS2, respectively, and two rear loudspeakers LS3 and LS4, respectively, each receiving signals from separate power amplifiers via output terminals O1, O2, O3 and O4, respectively. The two front loudspeakers could for instance be installed in the front doors of the vehicle as is typically the case or in the dashboard of the vehicle. The cabin 2 furthermore comprises left and right front seats 3 and 4, respectively, and a back seat 5. The actual loudspeaker set-up including also the shown number of loudspeakers is of course only given as an example of an application of the invention, and any other sound reproduction installations including a purely monaural installation (i.e. only one input terminal of the equipment and possibly also only a single loudspeaker) could be simulated by means of the systems and methods according to the invention.

In order to be able subsequently to carry out listening tests, for instance to assess the sound quality of the installed sound reproduction equipment under realistic acoustic conditions, binaural vehicle impulse responses (BVIRs) are measured with the aid of an acoustic mannequin comprising an artificial head 12 with suitable pinna replicas and corresponding microphones 19 and a torso portion 13 upon which the head 12 is mounted for rotation around a substantially vertical axis. The rotation of the head 12 relative to the torso portion 13—and hence relative to the cabin 2 of the vehicle—is controlled by the measuring system 101 which provides a control signal 18 to a drive mechanism comprising a motor housed within the torso portion 13. Thus by means of this set-up, BVIRs can be measured corresponding to a given number of rotational angles of the head 12 relative to the cabin 2 of the vehicle. Each of these measured impulse responses is stored in suitable data storage means in the measuring system together with an identifier defining the corresponding rotational angle of the head.

In the set-up shown in FIG. 1, the mannequin 12, 13 is as an example positioned to the right on the back seat 5, but it could of course be positioned at any realistic position in the cabin of the vehicle including on the driver's seat 3.

It is understood that although the acoustic mannequin described in connection with this embodiment of the invention comprises a head 12 which can undergo controlled rotation about the vertical axis through the mannequin, corresponding to horizontal head movements relative to the torso of a listener, a more sophisticated mannequin could provide for controlled movement of the head both horizontally and in a vertical plane through the mannequin, thus providing basis for simulation of a completely realistic listening session, in which a test subject is free to make any movements of the head relative to the torso, at least within anatomically determined limits. The ability to carry out listening tests on simulated sound fields, for instance in the cabin of a vehicle during which absolute freedom of movement of the test subject's head relative to his torso is allowed and actually accounted for during the simulation, may well be important under certain circumstances, for instance in comparing two loudspeaker set-ups comprising loudspeakers positioned at different vertical levels relative to the listener.

Returning to FIG. 1, the system according to this embodiment furthermore comprises a measurement system 10 for determining the BVIR described above, the measurement system 10 being provided with (at least) two input terminals $I_1$, $I_2$ receiving signals 14 and 15 for the microphones 19 and 20, respectively, in the artificial head 12. The measuring system 10 is furthermore provided with generator means for generating a suitable signal used for measuring the impulse response, said signal being provided at an output terminal 16 of the measuring system 10 and coupled to the input terminals $I_L$ and $I_R$ of the sound-processing equipment 11 of the vehicle. Measurements of BVIR could in principle take place with the signal from the generator coupled to both input terminals of the sound processing device 11, but usually the impulse responses for each of the channels of the device will be measured separately, i.e. two successive measurements with the switch SW1 in either position L or R will be carried out.

As mentioned above, the measuring system 10 according to this embodiment of the system according to the invention furthermore comprises means for delivering a control signal 18 to the drive means of the head 12 in the mannequin. Furthermore, the measuring system 10 may comprise means for actually storing the measured impulse responses, although these data—together with an appropriate horizontal angle identifier—would preferably be transferred to a data storage means or data base for subsequent use, such means being not shown in FIG. 1 but being shown and described in more detail in connection with FIG. 3.

The second part of the system according to an embodiment of the invention shown in FIG. 1 comprises a binaural recording device 22, which could comprise a further data base for storing binaural recordings of noise in the cabin at e.g. different driving conditions made at the various angular orientations of the head, also as appropriately provided with a suitable horizontal angle identifier, which could be provided (on control line 23 as shown in FIG. 1) by the measuring system 10. It is, however, understood that the binaural recording device could be a completely separate device not necessarily controlled from the measuring system 10, and that the above-mentioned identifiers of the binaural recording device 22 could also be provided for instance by purely manual means via a suitable interface. Alternatively, the binaural recording device 22 may itself comprise control means for delivering a control signal 71 to the head drive means in the artificial head.

The binaural vehicle impulse responses (BVIRs) measured as described above correspond basically to the transmission paths indicated by I, II, III and IV in FIG. 1 plus all the transmission paths corresponding to sound reflections from the various boundaries of the cabin. These impulse responses relate to the sound reproduction of the installed audio equipment in the particular cabin of a vehicle, in the present context the "wanted sound". Similarly the noise signals recorded by the binaural recording device 22 within the present context represent "unwanted" or "disturbing" sound, which may either in itself be annoying or/and which may affect the perceived sound quality (or other pertinent psychoacoustic attributes such as speech intelligibility) of the wanted sound.

Figure 2:
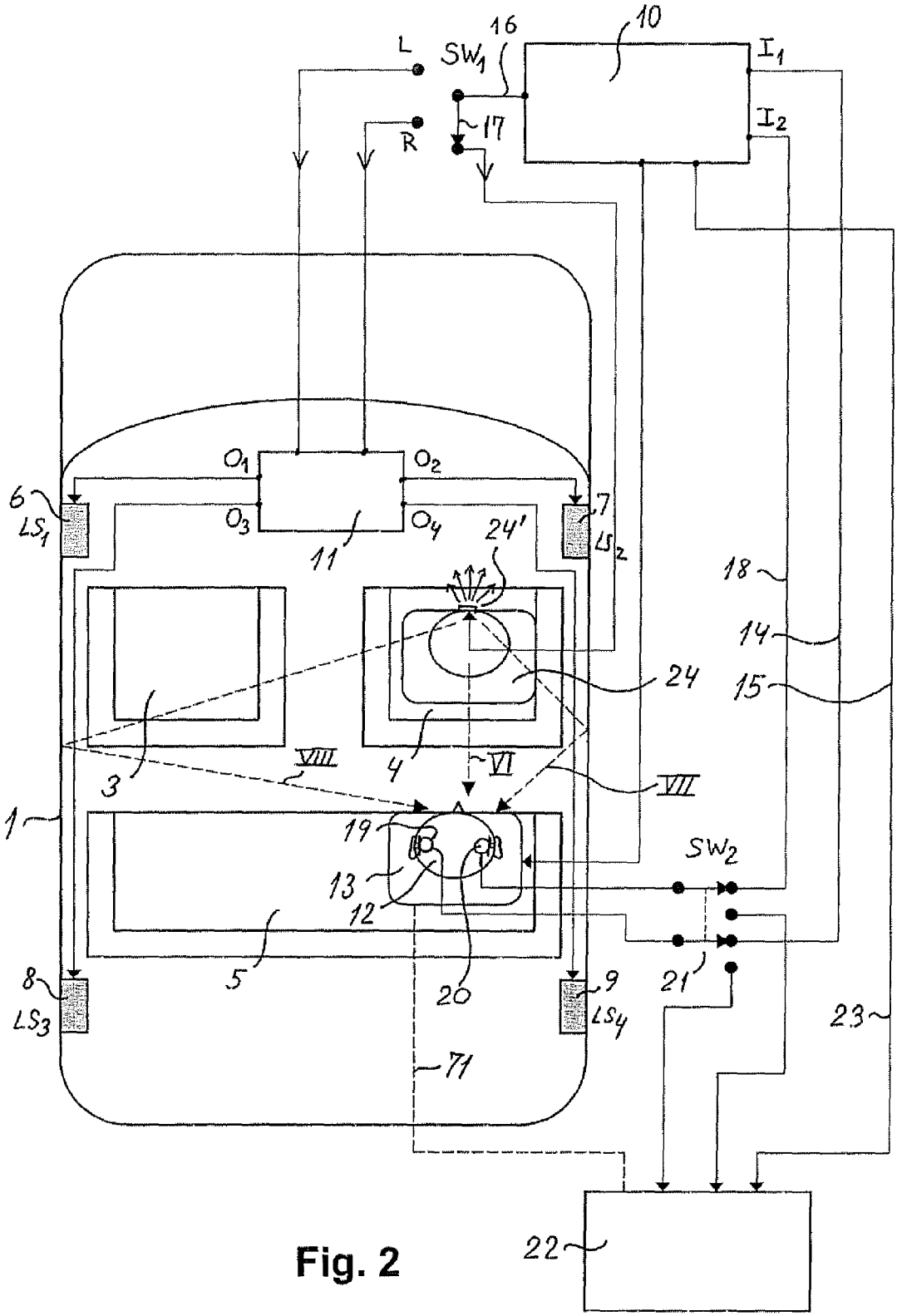
FIG. 2 represents the same basic set-up as shown in FIG. 1 but this time used for measuring binaural vehicle impulse responses corresponding to a competing sound, in the example shown in FIG. 2 speech from a person sitting in the right front seat.

Now referring to FIG. 2 there is shown a set-up used for simulation of a (or if desired a plurality) competing sound source (which in principle may emit either stationary noise or a time-varying signal). In the example shown in FIG. 2, the competing sound is a speaker sitting in the right front seat and the listener is still sitting to the right of the back seat as in FIG. 1. The speech signal from the speaker in the right front seat may affect the listener's perception (either due to purely acoustic factors or due to factors of a more psychological nature due to distraction of the listener) of the sound-reproduction equipment in the cabin and this effect is simulated by the set-up in FIG. 2 either alone or in combination with background noises recorded binaurally as described above in connection with FIG. 1. The effect of the competing sound is simulated by measuring and storing binaural vehicle impulse responses with the output signal from the measuring system 10 provided to an acoustic mannequin 24, which is provided with transducer means 24' (such as an "artificial mouth") for simulating a speech signal emitted from a replica of a human mouth in the head of the acoustic mannequin 24. Thus, the measuring signal provided by the measuring system 10 is delivered to the mouth simulator 24' in the mannequin 24, emitted from the mouth simulator 24' and picked up by the microphones 19 and 20 of the mannequin 12, 13 and delivered to the input terminals I1 and I2 of the measuring system 10 as described above in connection with FIG. 1. Again these impulse responses can be measured and stored for a number of orientations of the head 12 of the mannequin simulating the human listener and also, if desired, for a number of orientations of the mannequin 24 simulating the speaker. It is of course understood that other types of competing sounds than speech may be of interest in the present context. A given binaural impulse response (i.e. with given orientations of the heads of the two mannequins) comprises contributions from various sound transmission paths, of which three are shown in FIG. 2, i.e. reflections from the sides or window portions of the cabin VII and VIII and the direct sound transmission path VI.

Figure 3:
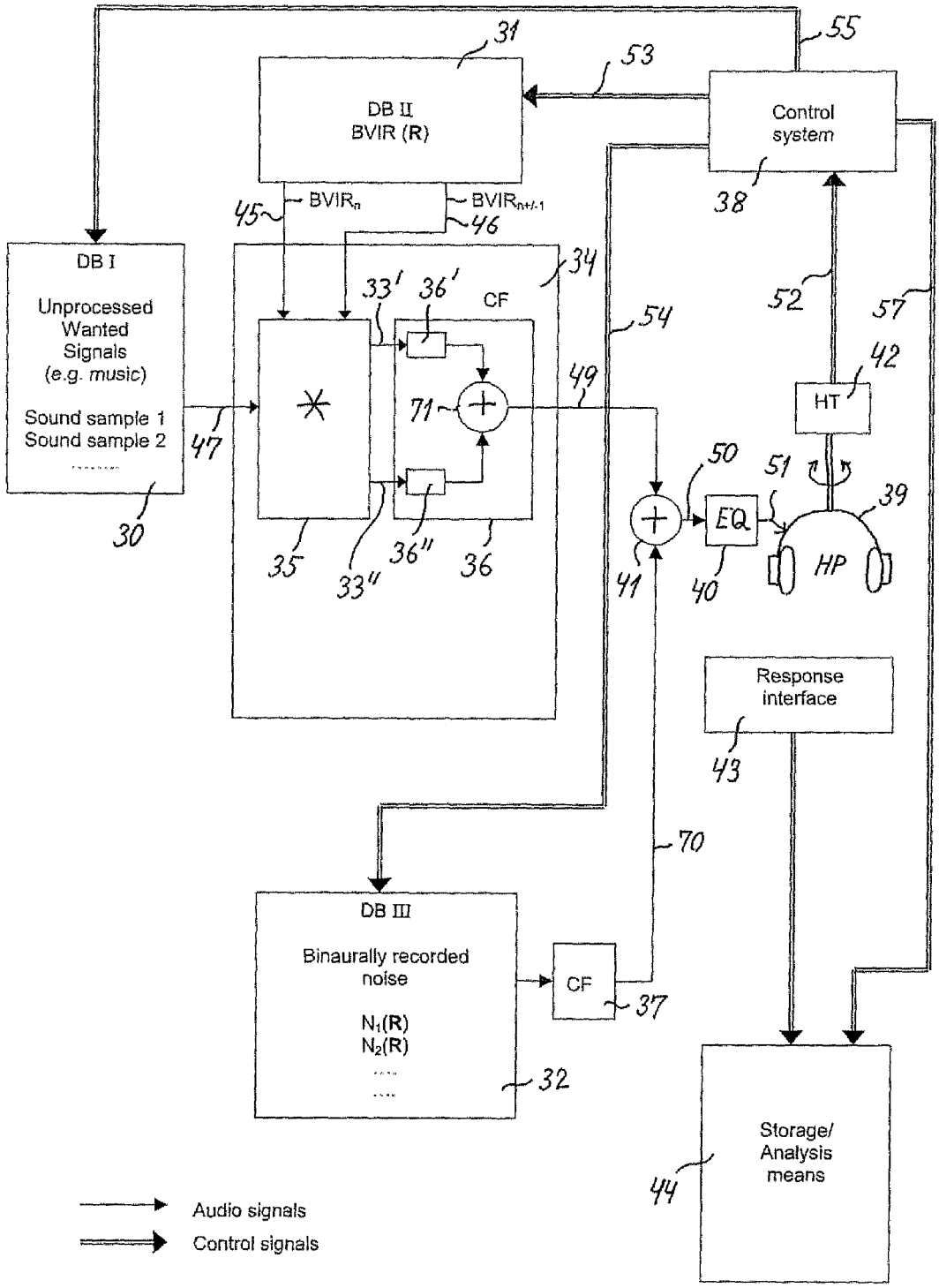
FIG. 3 shows a schematic block diagram of an embodiment of a playback system according to the invention for carrying out listening tests on for instance sound quality of audio reproduction equipment installed in the vehicle of FIG. 1.

Referring to FIG. 3 there is now shown a schematic block diagram of an embodiment of a playback/simulation system according to the present invention. The system according to this embodiment comprises data bases referred to as DBI, DBII and DBIII in FIG. 3 for storing samples of wanted sounds, such as musical excerpts, binaural vehicle impulse responses (BVIR) and binaural recordings attained by means of the set-ups shown in FIGS. 1 and 2. The system furthermore comprises various signal processing means for processing and combining signals from the data bases, means for reproducing these processed signals and control means for controlling the listening test sessions carried out with the system. Finally, the system may comprise appropriate test subject response interfaces, by means of which a test subject can response to various sound stimuli provided by the system and linked to response storage and/or analysis means for storing and possibly analyse responses given by test subjects.

Reference numeral 30 indicates database DBI comprising unprocessed versions of sound files (sound sample (1) . . . ) which may for instance consist of various excerpts of music or other sound material typically reproduced via an audio installation in a vehicle.

Reference numeral 31 indicates data base DBII comprising binaural vehicle impulse responses corresponding to the complete sound reproduction chain from the electrical inputs $I_L$ and $I_R$ to the ear microphones 19, 20 of the artificial head 12 as measured with the set-up shown in FIG. 1, i.e. one BVIR for each of the above-mentioned orientations of the artificial head 12. These impulse responses are indicated by BVIR(R) in FIG. 3, where R is a head-related vector indicating the orientation of the head relative to the torso 13 of the mannequin or to the cabin 2 of the vehicle.

Reference numeral 32 indicates data base DBIII comprising binaural recordings of stationary or quasi-stationary noise signals from the vehicle recorded via the artificial head 12 as described in connection with FIG. 1 above. The various noise signals are indicated by the vector notation $N_i(R)$, i indicating the various noise examples in the data base and R the orientation of the artificial head 12.

Based on the data stored in the above-mentioned data bases, the sound reproduction of the audio equipment installed in the cabin plus various background noises from the vehicle are simulated and reproduced by the playback system shown in FIG. 3. The reproduction of the wanted sound is simulated by convolution (symbolised by the asterisk in block 35 of FIG. 3) of a chosen sound sample from data base DBI with an appropriate $BVIR_n$ stored in DBII corresponding to the actual orientation of the test subject's head assessed by means of a suitable head-tracking device 42 associated with the headphone 39 worn by the test subject. The chosen wanted sound signal is furthermore convolved with the binaural vehicle impulse responses $BVIR_{n+/-1}$ corresponding to the two neighbouring orientations of the artificial head 12.

Thus, in the processing means 34 convolution takes place of said chosen wanted sound signal 47 with two binaural vehicle impulse responses $BVIR_n$ and $BVIR_{n+/-1}$ 45, 46 which are chosen based on the tracking of the head of the test subject by the tracking means 42, thus yielding first and second processed versions 33', 33", respectively, of the wanted sound signal 47 where the two versions 33', 33" are separately provided to cross-fading means 36', 36", the output signals from each of these cross-fading means being provided to a combining means 71 for providing a combined output signal 49 from the processing means 34.

According to a specific embodiment of the invention, the cross-fading means 36 comprises means 36' for multiplying the first version 33' with a first time-dependent function q(t) yielding a first output signal and means 36" for multiplying the second version 33" with a second time-dependent function p(t) yielding a second output signal and means 71 for adding the first and second output signals, thereby providing the processed output signal 49 from the processing means 34.

Specifically said second function p(t) could equal 1/q(t) but other relationships between q(t) and p(t) would also be possible.

During playback, a specific processed signal 49 corresponding to a specific orientation and movement of the test subject head is mixed in a mixer 41 with a corresponding processed noise signal 70. The processing to the noise signal takes place in a manner analogous to the cross-fading performed during processing of the wanted sound signals as described above (but of course without the convolution carried out in the processing means 34), i.e. a cross-fading between a given noise signal $N_i(R)$ and a neighbouring noise signal, i.e. a noise signal recorded with a neighbouring orientation of the artificial head 12 is carried out in the manner described above, thus resulting in a processed binaural noise signal 70. The mixed signal comprising the signal 49 corresponding to the processed wanted sound signal and the signal 70 corresponding to the processed noise signal (where the mixing may incorporate relative adjustment of the individual levels of these signals if desired) is provided to the headphone 39 via (if desired) suitable frequency shaping or other signal processing means 40, used for instance to attain the desired transfer function of the headphone 39.

As mentioned previously, the database DBII, 31 may alternatively comprise individual functions $H_{IND}(R)$. In this case, the processing means 34 must furthermore comprise means for determining the functions H(R) based on the appropriate individual functions.

As a further alternative, the database DBII, 31 may comprise both individual functions $H_{IND}(R)$ and the corresponding functions H(R), the latter either being previously determined based on the corresponding individual function or being measured with sound radiation from all loudspeakers in the installation.

Figure 4:
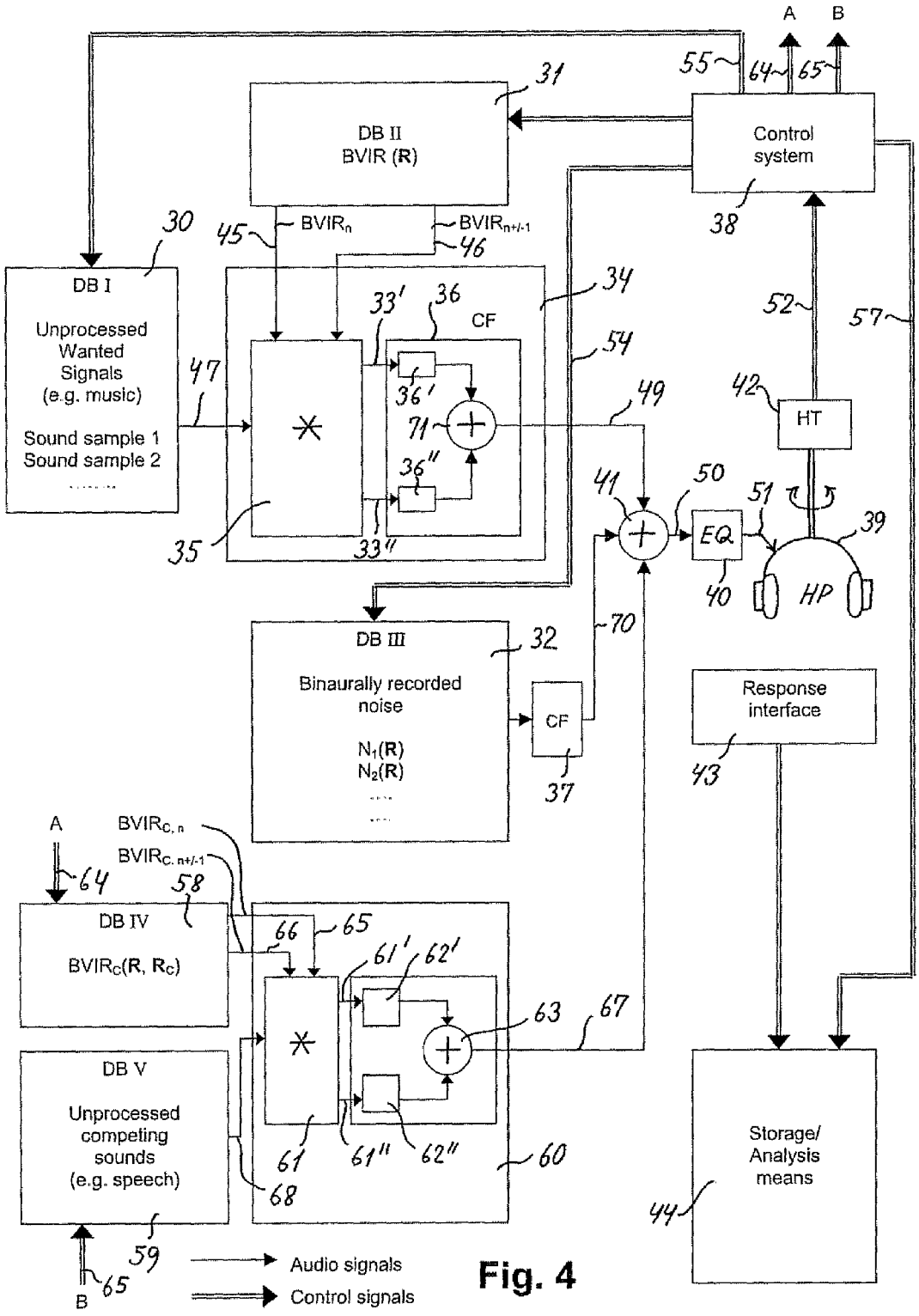
FIG. 4 shows a schematic block diagram of a second embodiment of a playback system according to the invention provided with means for simulating competing sounds in the cabin of a vehicle.

Referring to FIG. 4 there is shown a schematic block diagram of a second embodiment of a playback system according to the invention provided with means for simulating competing sounds in the cabin of a vehicle. Devices and functional blocks similar to those shown in FIG. 3 are referred to by the same reference numerals as in FIG. 3 and will not be described again.

According to this embodiment there is furthermore provided storage means 58 for storing the function $H_C(R_C; R)$, such as the BVIR, characterising the relationship between a sound pressure generated in or at the ear canal replica of said artificial head 12 with the head 12 having a given orientation R relative to said sound field and an input signal provided to said sound-generating means 24 (in FIG. 2 exemplified with an artificial head 24 provided with a suitable artificial mouth), where $R_C$ indicates the orientation of the sound-generating means 24 relative to said sound field.

The system according to this embodiment furthermore comprises processing means 60 for processing competing sound signals 68 dependent on the movement and/or orientation of the test subjects as sensed by said tracking means 42, thereby providing processed competing sound signals 67 and mixing means 41 for mixing the processed competing sound signals 47 with said binaural recordings of sound signals or processed 37 versions 70 of these signals and with said processed versions 49 of wanted sound signals in given proportions, whereby mixed signals 50 are provided to the headphone 39 either directly or via suitable processing means 40 as described above.

According to a specific embodiment, said function $H_C(R_C; R)$ is a binaural vehicle impulse response $BVIR_C$ and said processing means 60 comprises means 61 for carrying out convolution of a chosen competing sound signal 68 with chosen binaural vehicle impulse responses $BVIR_C$ corresponding to competing sounds.

Thus according to this embodiment of the invention, convolution takes place in the processing means 60 of said chosen competing sound signal 68 and two binaural vehicle impulse responses ($BVIR_{C,n}$ and $BVIR_{C,n+/-1}$), 65, 66 which are chosen based on the tracking of the head of the test subject by the tracking means 42 thus yielding first and second processed versions 61', 61", respectively, of the competing sound signal 68, where the two versions 61', 61" are separately provided to cross-fading means 62', 62", the output signals from each of these cross-fading means being provided to a combining means 63 for providing a combined output signal 67 from the processing means 60.

The cross-fading means 62 comprises means 62' for multiplying said first version 61' with a first time dependent function $q_1(t)$ yielding a first output signal and means 62" for multiplying said second version 61" with a second time dependent function $p_1(t)$ yielding a second output signal. Specifically $p_1(t)$ may equal $1/q_1(t)$.

The system according to the embodiment shown in FIG. 4 furthermore comprises storage means 59 for storing samples of the competing sound signals.

According to a specific embodiment of the system according to the invention described in the summary of the invention and in the detailed description of the invention, the storage means or data bases 31 and 58 contain BVIRs comprising data for two simultaneous sound sources relative to one listener, i.e. the left and right channel of the sound reproduction equipment including the various loudspeakers installed in the vehicle. The database 31 comprising binaural vehicle impulse responses corresponding to the reproduction equipment may contain BVIRs for 61 orientations R of the artificial head/the head of the test subject ranging from −30 degrees to +30 degrees in the horizontal plane in steps of 1 degree. This corresponds to a single physical set-up of the reproduction equipment. Generally a plurality of such storage means/databases can be incorporated into the system and handled by the playback system, thus allowing for fast switches between different reproduction equipment set-ups. The convolution software may include a number of user programmable dynamically linked libraries (DLL) allowing for programming of additional modules to the software. Such features can be used in connection with the playback of the background noises during listening tests as well. Furthermore, playback of binaural recordings from storage means 32 may take place in a looped manner, whereby the sound files stored in this storage means may be comparatively short, which is advantageous during actual recording to these sound files in a moving vehicle.

The invention claimed is:

1. A system for recording acoustical quantities or sound samples characterising a sound field at least partly generated in a room by electroacoustic reproduction equipment comprising one or more transducers such as loudspeakers, the system comprising an acoustic mannequin comprising an artificial head and a torso portion for making binaural recordings of sounds in said room, and generator means for providing measurement signals to input terminals of said electroacoustic reproduction equipment and determining means for determining a function H(R) characterising the relationship between a sound pressure generated in or at the ear canal replicas of said artificial head, the head having a given orientation R relative to said sound field, and an input signal to said electroacoustic reproduction equipment, where the system furthermore comprises storage means for storing said function H(R) and storage means for storing binaural recordings Ni(R) made by means of said acoustic mannequin of other signal components of said sound field, such as background noises.

2. A system according to claim 1, where said function H(R) is determined by providing a given of said input terminals with said measurement signal and based on the measuring signal radiating sound from all of said transducers simultaneously.

3. A system according to claim 1, where said function H(R) is determined by providing a given of said input terminals with said measurement signal and based on the measuring signal radiating sound from either a single one of said transducers at a time or from a given number of said transducers at a time, whereby individual functions HIND(R) are determined and based on these individual functions HIND(R) determining said function H(R).

4. A system according to claim 1, where said function H(R) or HIND(R) is the binaural room impulse response BRIR.

5. A system according to claim 1, where said function H(R) is the binaural transfer function H(f;R).

6. A system according to claim 1, where the system furthermore comprises sound-generating means for emitting a competing sound signal such as speech.

7. A system according to claim 6, where said sound-generating means is an acoustic mannequin provided with an artificial mouth.

8. A system according to claim 6, where the system is furthermore provided with storage means for storing a function HC(RC;R) characterising the relationship between a sound pressure generated in or at the ear canal replicas of said artificial head with the head having a given orientation R relative to said sound field and an input signal provided to said sound-generating means, where RC indicates the orientation of the sound-generating means relative to said sound field.

9. A system according to claim 8, where said function HC(RC;R) is the binaural room impulse response BRIRC corresponding to the competing sound.

10. A system according to claim 8, where said function HC(RC;R) is the binaural transfer function HC(f;R) corresponding to the competing sound.

11. A system according to claim 1, where said room is the cabin of a vehicle.

12. The use of a system according to claim 1, for the assessment of psychoacoustic attributes relating to the sound field in an enclosure such as the cabin of a vehicle, or for comparing such psychoacoustic attributes relating to sound fields in the cabins of different vehicles.

13. The use of a system according to claim 1 for simulating the acoustic environment at least in the following environments: the cabin of a vehicle, air craft cabins, railway compartments, space shuttles, assembly halls, kitchens and bathrooms.

14. A system according to claim 1, where Ni(R) is considered the primary signal and coming from other sound-generating entities than cars, such as various kinds of large machinery.

15. A system for carrying out listening tests on simulated sound fields in a room, the system comprising:

storage means for storing a function H(R), characterising the relationship between a sound pressure generated in or at the ear canal replicas of an artificial head with the head having a given orientation R relative to said sound field and an input signal to an electroacoustic reproduction equipment provided in said room;

storage means for storing binaural recordings Ni(R) of sound signals made in said room;

means for providing wanted sound signals;

binaural sound reproduction means for providing a test subject with an acoustic test signal, where the binaural sound reproduction means is provided with tracking means for tracking the movement and/or orientation of the head of the test subject relative to said sound field;

processing means for processing said wanted sound signals dependent on the movement and/or orientation of the test subjects as sensed by said tracking means;

mixing means for mixing the processed wanted sound signals with said binaural recordings of sound signals or processed versions of these signals in given proportions, whereby mixed signals are provided;

means for providing said mixed signals to input terminals of said binaural sound reproduction means.

16. A system according to claim 15, where said storage means alternatively or furthermore stores said individual functions HIND(R).

17. A system according to claim 16, where said processing means furthermore comprises means for determining said function H(R) based on said individual functions HIND(R).

18. A system according to claim 15, where said function H(R) or HIND(R) is the binaural room impulse response BRIR and where said processing means comprises means for carrying out convolution of a chosen wanted sound signal with chosen binaural room impulse responses.

19. A system according to claim 18, in which convolution takes place in the processing means of said chosen wanted sound signal with two binaural room impulse responses (BRIRn and BRIRn+/−m), which are chosen based on the tracking of the head of the test subject by said tracking means, thus yielding first and second processed versions, respectively, of the wanted sound signal where the two versions are separately provided to cross-fading means, the output signals from each of these cross-fading means being provided to a combining means for providing a combined output signal from the processing means.

20. A system according to claim 19, where said cross-fading means comprises means for multiplying said first version with a first time dependent function q(t) yielding a first output signal, and means for multiplying said second version with a second time dependent function p(t) yielding a second output signal, and means for adding the first and second output signals.

21. A system according to claim 20, where said second function p(t) equals 1/q(t).

22. A system according to claim 15, where said processed versions of binaurally recorded signals are attained by cross-fading carried out between a given one of these signals Ni(R) with a neighbouring signal recorded with a neighbouring orientation of the artificial head.

23. A system according to claim 22, where said cross-fading involves the multiplication of the given noise signal Ni(R) with a first time dependent function, the multiplication of said neighbouring noise signal with a second time dependent function and the combination/addition of these two multiplied signals, whereby said processed version of the binaurally recorded signal is attained.

24. A system according to claim 15, where the system furthermore comprises storage means for storing samples of wanted sound signals, such as excerpts of music.

25. A system according to claim 15, where the system furthermore comprises:

storage means for storing a function HC(RC; R) characterising the relationship between a sound pressure generated in or at the ear canal replica of said artificial head with the head having a given orientation R relative to said sound field and an input signal provided to said sound-generating means, where RC indicates the orientation of the sound-generating means relative to said sound field;

processing means for processing competing sound signals dependent on the movement and/or orientation of the test subjects as sensed by said tracking means, thereby providing processed competing sound signals; and mixing means for mixing the processed competing sound signals with said binaural recordings of sound signals or processed versions of these signals and with said processed versions of wanted sound signals in given proportions, whereby mixed signals are provided.

26. A system according to claim 25, where said function HC(RC; R) is a binaural room impulse response BRIRC and where said processing means comprises means for carrying out convolution of a chosen competing sound signal with chosen binaural room impulse responses BRIRC corresponding to competing sounds.

27. A system according to claim 26, in which convolution takes place in the processing means of said chosen competing sound signal and two binaural room impulse responses (BRIRC,n and BRIRC,n+/−m) which are chosen based on the tracking of the head of the test subject by said tracking means, thus yielding first and second processed versions, respectively, of the competing sound signal, where the two versions are separately provided to cross-fading means, the output signals from each of these cross-fading means being provided to a combining means for providing a combined output signal from the processing means.

28. A system according to claim 27, where said cross-fading means comprises means for multiplying said first version with a first time dependent function q1(*t*) yielding a first output signal, and means for multiplying said second version with a second time dependent function p1(*t*) yielding a second output signal.

29. A system according to claim 28, where said second function p1(*t*) equals 1/q1(*t*).

30. A system according to claim 25, where the system furthermore comprises storage means for storing samples of competing sound signals such as speech.

31. A system according to claim 15, furthermore comprising an operational system for controlling provision of data from the storage means and for receiving and optionally analysing and/or recording responses from the test subject.

32. A system according to claim 15, where Ni(R) is the only signal provided to the listener and hence the sound signal related to said H(R) is turned off.

33. The use of a system according to claim 15 for the assessment of psychoacoustic attributes relating to the sound field in an enclosure such as the cabin of a vehicle, or for comparing such psychoacoustic attributes relating to sound fields in the cabins of different vehicles.

34. The use of a system according to claim 15 for simulating the acoustic environment at least in the following environments: the cabin of a vehicle, air craft cabins, railway compartments, space shuttles, assembly halls, kitchens and bathrooms.

35. A method for simulating the total sound field generated at least partly by a sound-reproduction equipment comprising one or more transducers for generating a sound field in a room, such as the cabin of a vehicle, said method comprising:

determining a plurality of functions H(R) or HIND(R), such as the binaural room impulse response corresponding to said reproduction equipment and storing these functions/impulse responses;

making a plurality of binaural recordings of other sound components such as background noises in the room and storing these recordings;

convolution of a chosen of said binaural room impulse responses with a sample of a wanted sound signal giving a resulting room-related simulation signal corresponding to this sound;

mixing said resulting simulation signal with a chosen one of said plurality of binaural recordings, thereby obtaining a binaural test signal for provision to a test subject via suitable binaural transducer means;

characterised in that said binaural transducer means are provided with means for tracking the motion and/or orientation of the test subject's head and that the signals provided by the tracking means are used for choosing said binaural room impulse responses and said binaural recordings.

36. A method according to claim 35, where said functions H(R) or HIND(R), such as the binaural room impulse response, are determined by providing a given input terminal of said sound-reproduction equipment with a measurement signal and based on the measuring signal radiating sound from all of said transducers simultaneously.

37. A method according to claim 35, where said functions H(R) or HIND(R), such as the binaural room impulse response, are determined by providing a given of said input terminals of said sound-reproduction equipment with a measurement signal and based on the measuring signal radiating sound from a given one of said transducers at a time or from a given number for said transducers at a time.

38. A method according to claim 35, characterised in that cross-fading is provided between a given first binaural room impulse response (BRIRn) and an adjacent second binaural room impulse response (BRIRn+/−m) and between a given binaural recording corresponding to said first binaural room impulse response and an adjacent binaural recording corresponding to said second binaural room impulse response, respectively, controlled by said signals provided by the tracking means.

39. A method according to claim 35, the method furthermore comprising determining a plurality of second functions HC(RC;R), such as second binaural room impulse responses corresponding to competing sounds and storing these functions/responses;

processing/convolution of a chosen of said second functions or binaural room impulse responses with a sample of a competing sound signal giving a resulting second room-related simulation signal corresponding to this competing sound;

mixing said resulting second simulation signal, said binaural test signal for provision of a resulting test signal comprising simulations of wanted sounds, competing sounds and background noises to a test subject via suitable binaural transducer means.

40. The use of a system according to claim 35 for the assessment of psychoacoustic attributes relating to the sound field in an enclosure such as the cabin of a vehicle, or for comparing such psychoacoustic attributes relating to sound fields in the cabins of different vehicles.

41. The use of a system according to claim 35 for simulating the acoustic environment at least in the following environments: the cabin of a vehicle, air craft cabins, railway compartments, space shuttles, assembly halls, kitchens and bathrooms.

42. A method for simulation of a sound field, where the method comprises:

provision of a plurality of stored binaural recordings of the sound field corresponding to different orientations of a listener's head in the sound field;

provision of a given of said binaural recordings to a listener via a binaural reproduction transducer, where the given binaural recording is chosen based on the actual orientation of the listener's head;

if the listener changes the orientation of the head, cross-fading to a second of said plurality of binaural recordings, where the second binaural recording is chosen based on the new orientation of the listener's head.

* * * * *